US011180912B2

(12) United States Patent
Chaves

(10) Patent No.: US 11,180,912 B2
(45) Date of Patent: Nov. 23, 2021

(54) DRAIN COVER

(71) Applicant: Luis Chaves, West Haven, CT (US)

(72) Inventor: Luis Chaves, West Haven, CT (US)

( * ) Notice: Subject to any disclaimer, the term of this patent is extended or adjusted under 35 U.S.C. 154(b) by 27 days.

(21) Appl. No.: 16/589,542

(22) Filed: Oct. 1, 2019

(65) Prior Publication Data

US 2021/0095460 A1 Apr. 1, 2021

(51) Int. Cl.

| | |
|---|---|
| ***E03F 5/04*** | (2006.01) |
| ***A47K 3/28*** | (2006.01) |
| ***A47K 3/40*** | (2006.01) |

(52) U.S. Cl.

CPC ..... *E03F 5/0408* (2013.01); *A47K 3/281* (2013.01); *A47K 3/40* (2013.01)

(58) Field of Classification Search

CPC ..... E03C 1/264

USPC ..... 4/286–295

See application file for complete search history.

(56) References Cited

U.S. PATENT DOCUMENTS

| | | | | |
|---|---|---|---|---|
| 2,433,423 | A * | 12/1947 | Broadman | E03F 5/0407 4/292 |
| 2008/0230469 | A1* | 9/2008 | Cherveny | E03C 1/264 210/455 |
| 2010/0213140 | A1* | 8/2010 | Won | E03C 1/264 210/767 |
| 2014/0259380 | A1* | 9/2014 | Eilmus | E03C 1/22 4/650 |
| 2016/0000280 | A1* | 1/2016 | Mardukhayev | A47K 13/18 4/245.5 |
| 2016/0305107 | A1* | 10/2016 | Muderlak | E03D 13/005 |
| 2018/0347161 | A1* | 12/2018 | Malesky | A61L 9/042 |

* cited by examiner

*Primary Examiner* — Christine J Skubinna

(74) *Attorney, Agent, or Firm* — IP Attorneys Group, LLC

(57) ABSTRACT

The present invention relates to a cover for a drain which traps hair or other debris traveling with water or other liquids down the drain. In most embodiments the drain cover comprises an outer and inner perimeter with one or more slits cut from the outer perimeter towards the inner perimeter. The shape and design of the drain cover allows it to cover any drain type, whether the grate is level with the bottom of the receptacle, recessed into the bottom of the receptacle, or whether a stopper sticks up from the bottom of the receptacle. In many embodiments the drain cover also comprises gaps for allowing water to flow through and projections for catching the hair or other debris.

20 Claims, 8 Drawing Sheets

DRAIN COVER

BACKGROUND OF THE INVENTION

The present invention relates to a device that covers a drain and keeps hair or debris from clogging the drain.

Often shower or sink drains get clogged with hair or other debris after use which can cause water to drain slowly or not at all. Typical methods for cleaning drains involve costly or caustic products such as lye, or manual removal of hair and debris with rods or other devices, which many users find repulsive. Some have used plastic or metal drain covers which are typically designed for longer use, but still need to be periodically cleaned, which can be unpleasant for the user. To catch hair, these drain covers are often designed with small holes, which can limit water flow and cause backups just as if the drain was clogged, somewhat defeating the purpose of a drain cover to prevent clogged, slow moving drains. In addition, these materials are typically not designed to be flexible or fit different shapes or areas, so these covers often do not effectively fill, fit around, or cover the drain, leaving gaps which hair and other debris can still escape through and clog the drain over time. In order to avoid the issue of mis-fitting drains, stores are often forced to keep many different drain covers of different shapes, styles, and sizes, which clog up inventory space and can be confusing for consumers.

In order to avoid the need to clean the drain cover, some have proposed disposable drain covers. However, these covers are often made of plastic or metal which cause an increase in landfill and pollution as neither plastic or metal typically degrade rapidly.

Thus, what is needed is a drain cover which can be shaped to the different types, styles, and sized drains, can be disposed of without having to engage with unseemly hair or unsanitary debris, and when disposed is easily degraded or recycled. Ideally, this drain cover should have features which catch the hair or other debris but does not significantly limit water flow.

SUMMARY OF THE INVENTION

The present invention relates to a device that covers a drain and keeps hair or debris from clogging the drain. In some embodiments the drain cover comprises an outer perimeter, an inner perimeter, and at least one slit between the inner and outer perimeters. In most embodiments the cover further comprises at least one feature which is a gap, a projection, or both.

In some embodiments the drain cover further comprises an outermost perimeter which is larger than the outer perimeter. In some embodiments with an outermost perimeter there is at least one notch located between the outermost perimeter and the outer perimeter. In some embodiments the drain cover has a number of petals which can overlap one another.

In some embodiments the drain cover is equipped with one or more fold lines, and in some of these embodiments the fold lines are perforated. In some embodiments the gap is a perforated section which can be removed by the user. In other embodiments the drain cover is equipped with a handle. In some embodiments the handle is connected at multiple points along the drain cover. In other embodiments the drain cover is equipped with a fastener selected from the group consisting of section cup, adhesive, tape, or combinations thereof.

In some embodiments the drain cover is made of all one material and in others it is made of multiple materials. In some embodiments at least one of the materials the drain cover is made up of is water-resistant. Similarly, in some embodiments the drain cover is made of one layer and in other embodiments it is made of multiple layers. In some embodiments at least one of the layers is water-resistant.

DETAILED DESCRIPTION OF THE INVENTION

Figure 1:
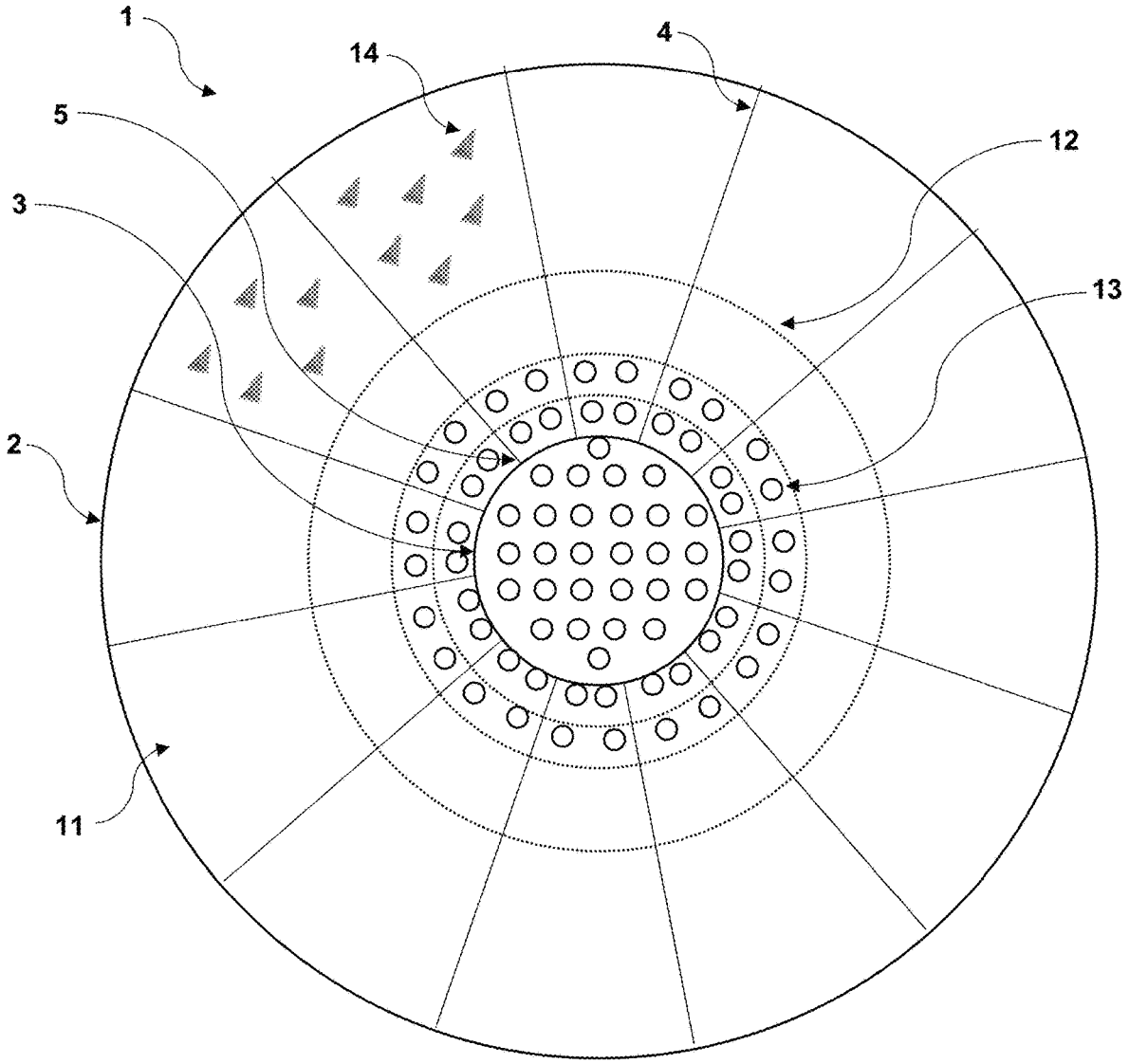
FIG. 1 shows a rear view of a drain cover according to one embodiment of the invention.

The present invention relates to a device that covers a drain and keeps hair or debris from clogging the drain. FIG. 1 shows a drain cover 1 according to one embodiment of this invention. As seen in FIG. 1, in this embodiment, drain cover 1 comprises an outer perimeter 2 and an inner perimeter 3. In some embodiments there is no inner perimeter 3. In some embodiments drain cover 1 is placed over the drain, in other embodiments drain cover 1 is placed inside of the drain, and in other embodiments drain cover 1 is placed on top of the drain. The shape of drain cover 1, outer perimeter 2, and inner perimeter 3 are chosen from the group consisting of circle, triangle, square, rectangle, pentagon, hexagon, heptagon, octagon, nonagon, decagon, polygon, and combinations thereof. In some embodiments, outer perimeter 2 and inner perimeter 3 are the same shape and in others they are different shapes.

Figure 4:
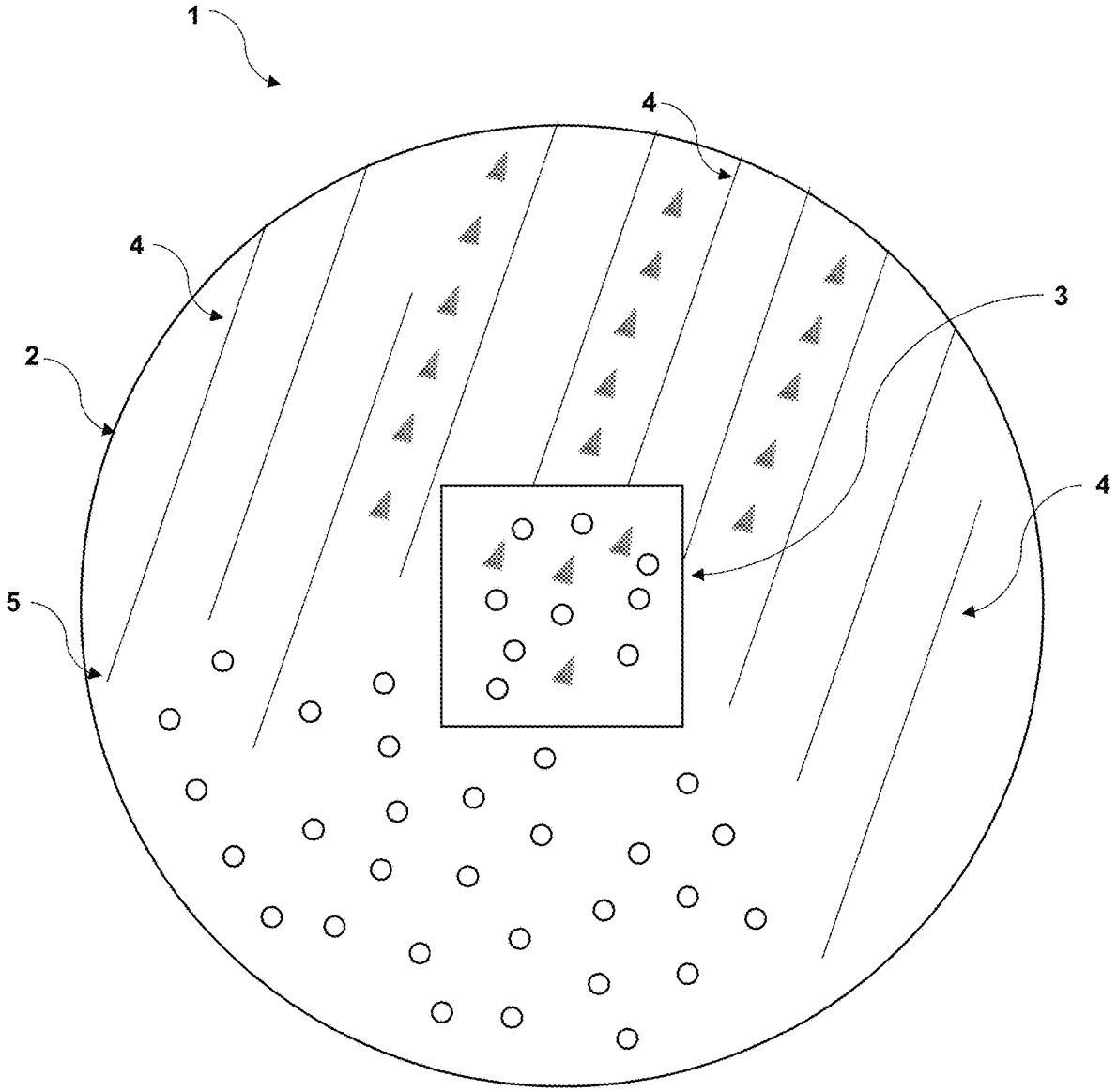
FIG. 4 shows a rear view of a drain cover according to an alternative embodiment of the one shown in FIG. 1.

In some embodiments, drain cover 1 further comprises slit 4. For the purposes of this patent, a slit is defined as a narrow cut or slice. An example of a slit would be the slice made in paper with a single cut of scissors or razor blade. In some embodiments, as seen in FIG. 1, slit 4 is located between outer perimeter 2 and inner perimeter 3. In some of these embodiments, the inner end of slit 4 defines the perimeter which makes up inner perimeter 3. In other embodiments, as seen in FIG. 4, slit 4 is located between outer perimeter 2 and its terminal internal point 5, which is not located on inner perimeter 3. In some embodiments, neither terminal point of slit 4 is located on outer perimeter 2, with both terminal points being located inside of outer perimeter 2, as seen in some of the slits 4 in FIG. 4. In some embodiments slit 4 is pre-cut and in other embodiments slit 4 is a perforated cut which can be optionally torn by the user. In some embodiments part of slit 4 is pre-cut and part of slit 4 is perforated. As discussed below, having slit 4 is useful for different drain types, thus, having perforated slits which allow the user to determine the length and number of slits is important as it allows the user to customize drain cover 1 to the different drain types the user has.

Figure 5:
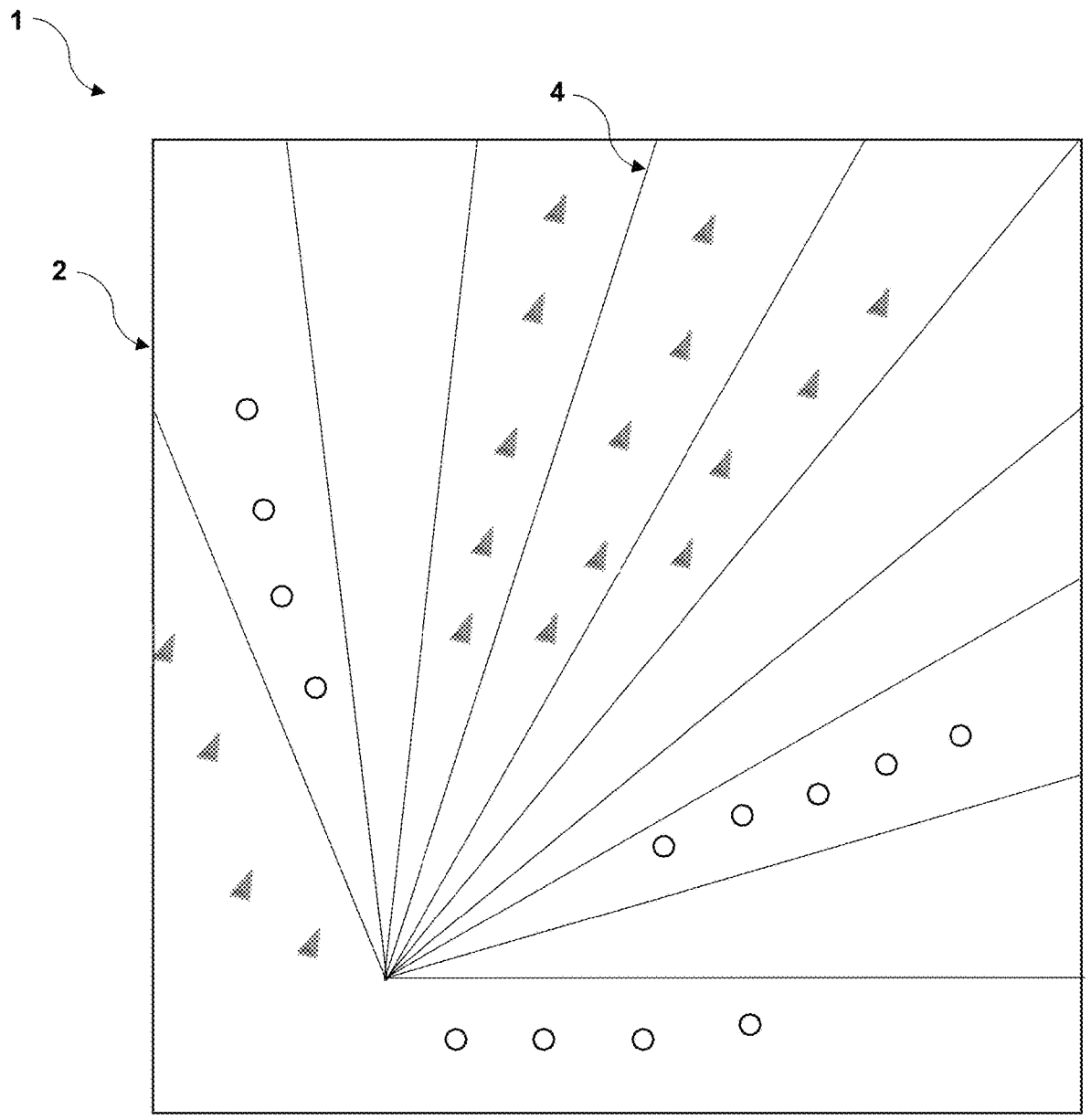
FIG. 5 shows a rear view of a drain cover according to an alternative embodiment of the one shown in FIG. 1.

In some embodiments, drain cover 1 only has one slit 4 and in other embodiments drain cover 1 has more than one slit 4. In some embodiments, the different slits 4 all terminate at approximately the same point, as in the embodiment shown in FIG. 5, in some embodiments only some of the different slits 4 terminate at the same point, and in other embodiments no slits 4 terminate at approximately the same point. In some embodiments all of the different slits 4 are generally the same length, and in other embodiments they are different lengths. In embodiments with more than one slit 4, the area between the slits is defined as petal 11.

Figure 6A:
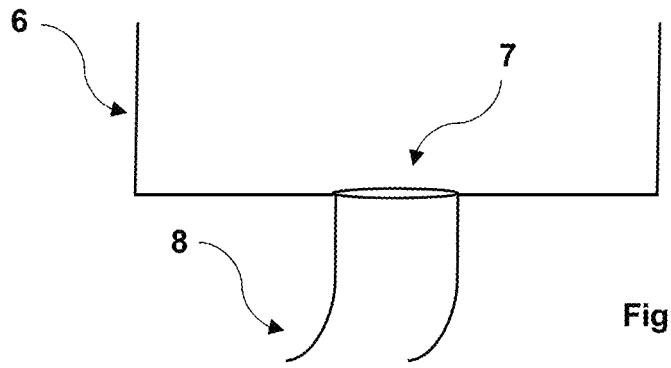
FIG. 6A shows a cross-sectional view of a first drain type.
Figure 6B:
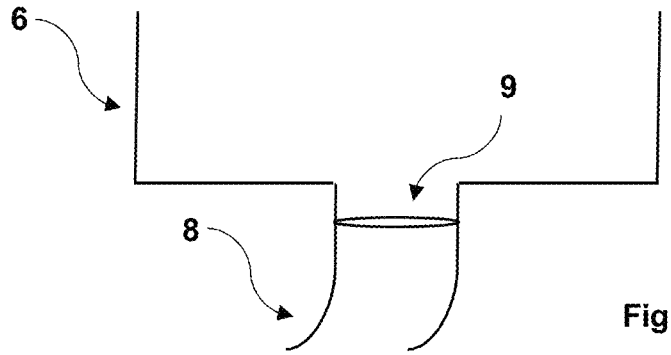
FIG. 6B shows a cross-sectional view of a second drain type.
Figure 6C:
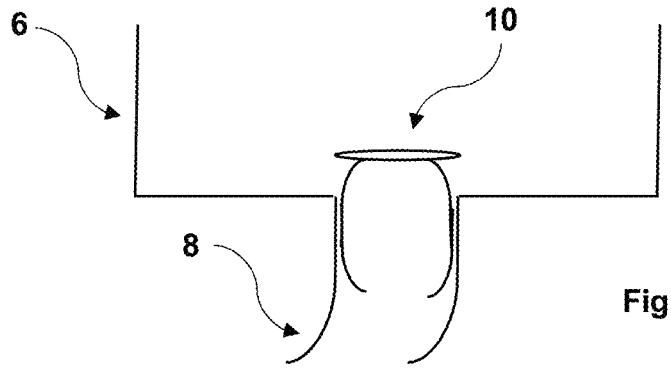
FIG. 6C shows a cross-sectional view of a third drain type.

The different slit 4 embodiments discussed above are useful for covering the different drain types. FIGS. 6A-6C show side views of the three main drain types located within receptacle 6. Receptacle 6 is a sink, tub, shower, or other device which has a drain that can be clogged. FIG. 6A shows a drain type which has grate 7 installed above the pipes 8, and is generally level with the bottom of receptacle 6. FIG. 6B shows a drain type which has grate 9 installed within pipes 8, generally below the bottom of receptacle 6. And FIG. 6C shows a drain type which has a stopper 10 that sticks out above the bottom of receptacle 6.

Figure 7A:
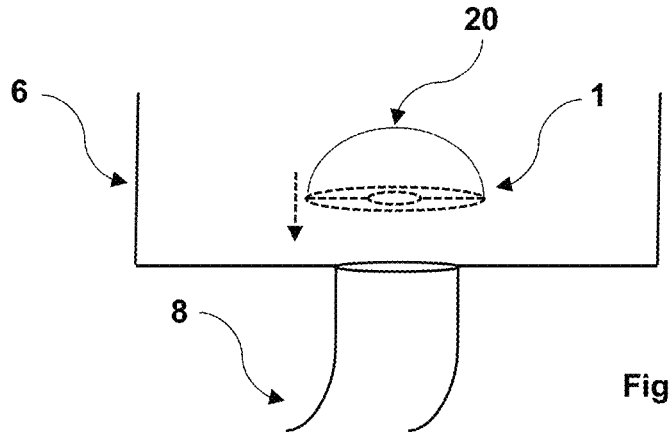
FIG. 7A shows how the drain cover shown in FIG. 1 fits on the drain type shown in FIG. 6A.
Figure 7B:
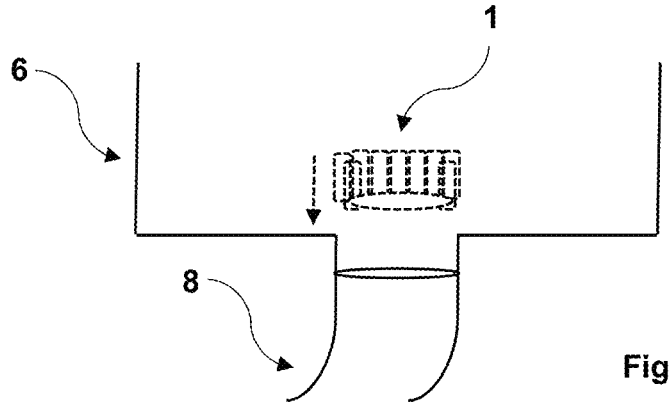
FIG. 7B shows how the drain cover shown in FIG. 1 fits on the drain type shown in FIG. 6B.
Figure 7C:
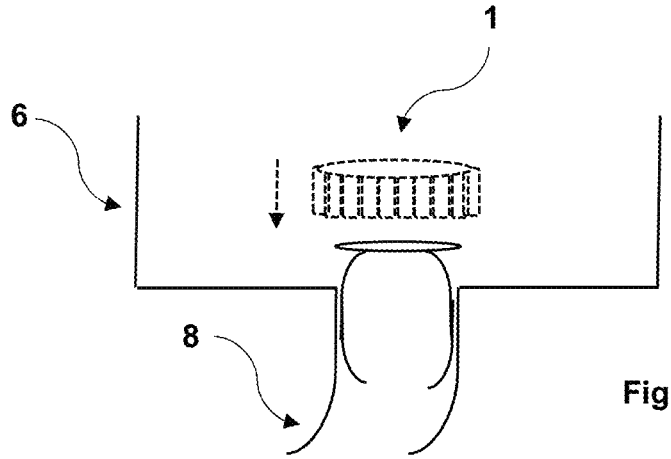
FIG. 7C shows how the drain cover shown in FIG. 1 fits on the drain type shown in FIG. 6C.

Embodiments with slit 4 located between outer perimeter 2 and inner perimeter 3 are useful for allowing drain cover 1 to fit over or into the various drain types. FIGS. 7A-C demonstrate how drain cover 1 with slit 4 located between outer perimeter 2 and inner perimeter 3 is modified to fit the different drain types discussed above and shown in FIGS. 6A-6C. For drains which have grate 7 installed above the pipes 8 and is generally level with the bottom of receptacle 6, drain cover 1 is placed flat over grate 7, as demonstrated by FIG. 7A. For drains which have grate 9 installed within pipes 8, generally below the bottom of receptacle 6, the petals 11 of drain cover 1 are folded approximately 90 degrees in an upward direction, allowing the area within inner perimeter 3 or fold line 12 to lay flat on top of grate 9 with petals 11 interacting with the drain walls above grate 9, as demonstrated by FIG. 7B. In some embodiments the length of petals 11 are long enough such that they can be further folded approximately 90 degrees such that they are parallel with the bottom of receptable 6, so that they can lay flat on the bottom of receptable 6. For drains which have a stopper 10 that sticks out above the bottom of receptacle 6, the petals 11 of drain cover 1 are folded approximately 90 degrees in a downward direction, allowing the area within inner perimeter 3 or fold line 12 to lay flat on top of stopper 10 with petal 11 interacting with the sides of stopper 10, as demonstrated by FIG. 7C. In some embodiments the length of petals 11 are long enough such that they can be further folded approximately 90 degrees such that they are parallel with the bottom of receptable 6, so that they can lay flat on the bottom of receptable 6.

In some embodiments, drain cover 1 is equipped with fold line 12. In some embodiments fold line 12 is located within outer perimeter 2, in other embodiments fold line 12 is located between outer perimeter 2 and inner perimeter 3, and in other embodiments fold line 12 is located within inner perimeter 3. In some embodiments inner perimeter 3 is a fold line 12, and in some embodiments outer perimeter 2 is a fold line 12. In most embodiments the purpose of fold line 12 is to aid in the folding of drain cover 1 or petal 11. In some embodiments fold line 12 is a dashed or solid line which denotes where drain cover 1 or petal 11 can be folded, which helps the user fold in a consistent shape or line. In other embodiments, fold line 12 is perforated, which allows for easier folding up of or tearing off of excess material. In other embodiments fold line 12 has been pre-folded to allow easier folding along fold line 12.

Figure 8A:
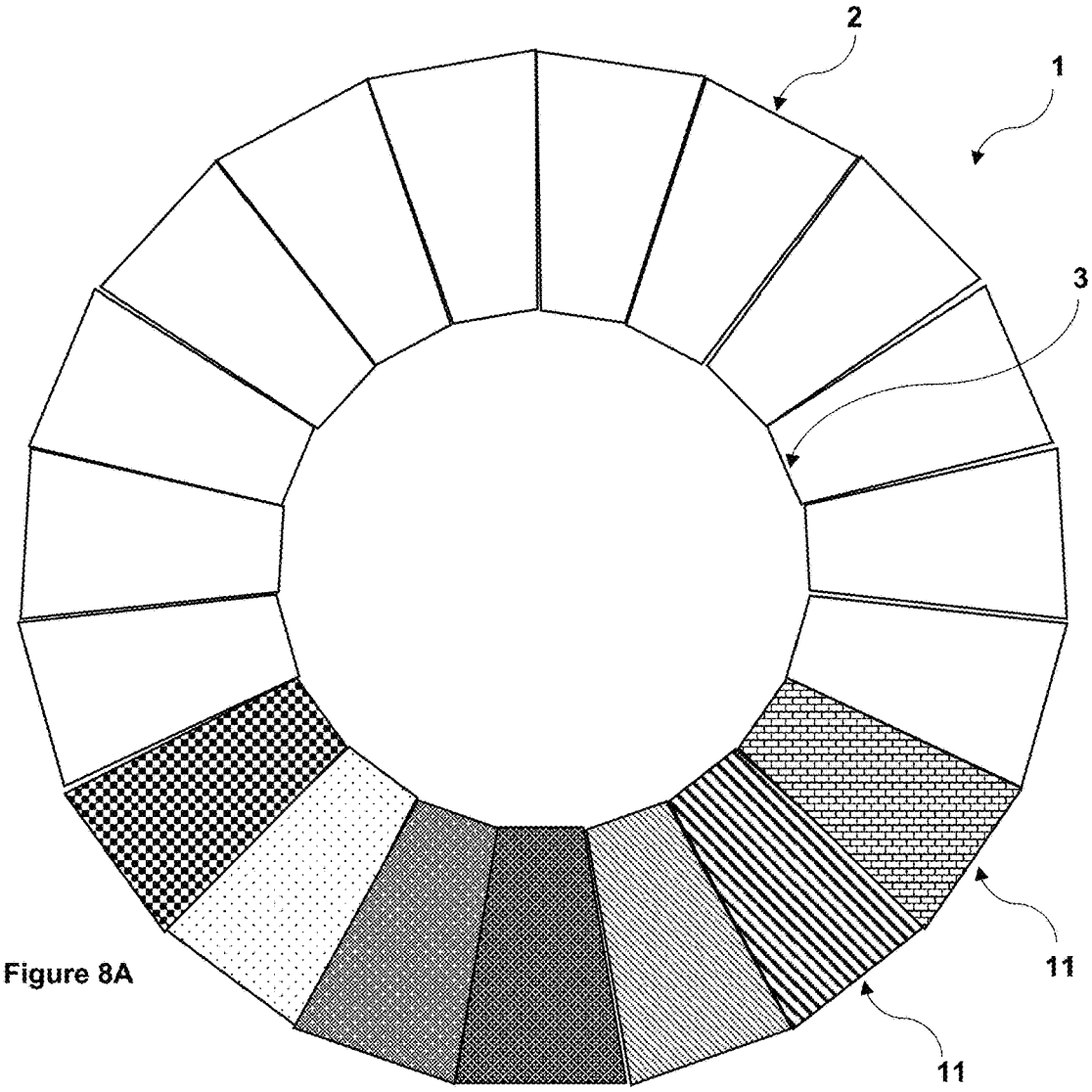
FIG. 8A shows another front view of the drain cover shown in FIG. 1, wherein this view highlights how some embodiments of the drain cover folds.
Figure 8B:
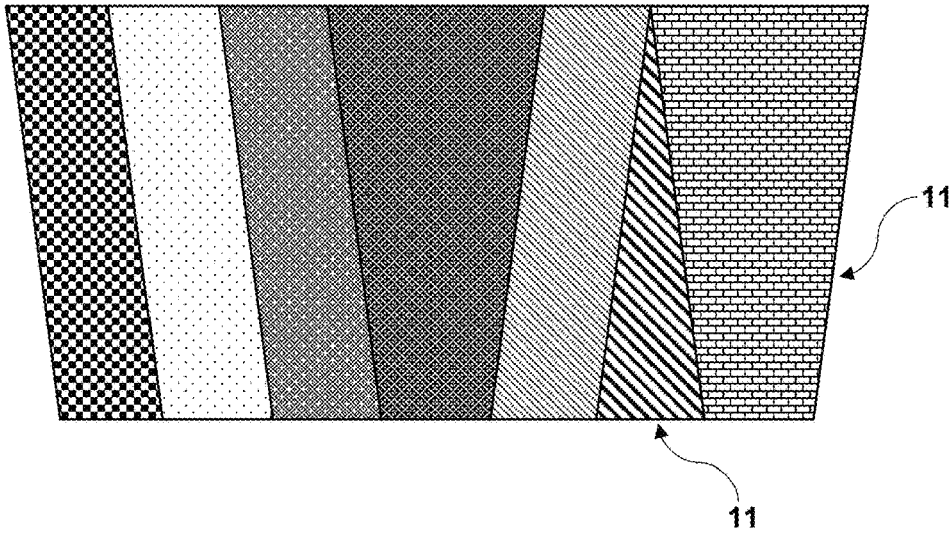
FIG. 8B shows a side view of the drain cover shown in FIG. 1, wherein this view highlights how some embodiments of the drain cover folds.

FIG. 8A shows a top view of one embodiment of drain cover 1 where some of the different petals 11 are shaded differently as a means of telling them apart and FIG. 8B shows a side view of the same embodiment of drain cover 1 where the petals are folded approximately 90 degrees in an upward direction. As can be seen in FIG. 8B, in many embodiments where outer perimeter 2 is larger than inner perimeter 3 or and other fold line 12 the petals 11 will overlap one another as they are folded up or down along inner perimeter 3 or fold line 12. In most embodiments the user can choose whether all of the petals 11 overlap one another in the same direction, as in the left side of FIG. 8B or whether they overlap in alternating directions as in the right side of FIG. 8B.

Figure 2:
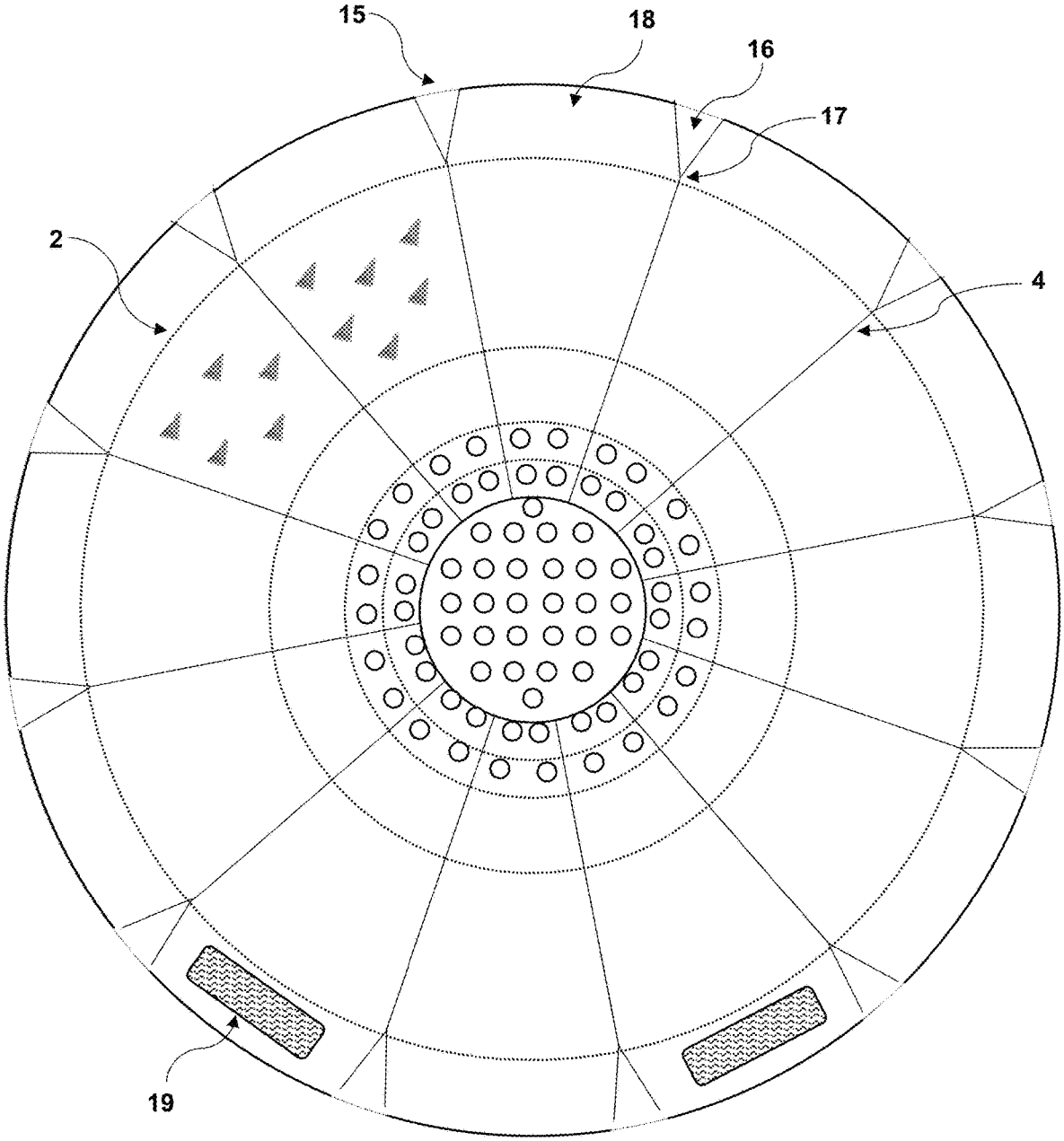
FIG. 2 shows a rear view of a drain cover according to an alternative embodiment of the one shown in FIG. 1.

As seen in FIG. 2, in some embodiments drain cover 1 comprises an outer perimeter 2 and an outermost perimeter 15. In the embodiment shown in FIG. 2, outer perimeter 2 is also a fold line 12. Between outermost perimeter 15 and outer perimeter 2 is notch 16 which removes some of the area between outermost perimeter 15 and outer perimeter 2. Thus, in embodiments such as the one shown in FIG. 2, outermost perimeter 15 is defined as the path or line which encompasses the entire area of drain cover 1 if notch 16 did not exist, and outer perimeter 2 is defined as the path or line which encompasses the entire are of drain cover 1 inside the innermost point (17) of notch 16. In embodiments with slit 4, notch 16 beneficially channels the water and allows it to flow towards slit 4. In embodiments without slit 4, notch 16 beneficially channels the water toward the center of drain cover 1 as a means of forcing the hair or debris to flow on top of and through drain cover 1 before entering the drain. In some embodiments, drain cover 1 is equipped with only one notch 16 and in other embodiments drain cover 1 is equipped with more than one notch 16. For embodiments with more than one notch 16, flap 18 has the ability to be folded up or down and further filters and channels the water. In some embodiments with multiple notched 16, all of the notches 16 are the same size and in other embodiments they are different sizes.

In some embodiments, drain cover 1 is equipped with gap 13 which allows water to pass through drain cover 1. In some embodiments gap 13 is a pre-cut gap or hole in drain cover 1, and in other embodiments gap 13 is a pre-perforated area which can be punched out by the user if desired. In some embodiments where fold line 12 is a pre-perforated line, this line also acts as the boundary for gap 13. In this way, the area outside of fold line 12 can be folded or torn off, or the area inside of fold line 12 can be removed to create gap 13. These embodiments are useful as they allow a larger gap 13 to fit around stopper 10 and lay generally flat around receptacle 6. In some embodiments with pre-perforated gap 13, gap 13 has within it one or more per-perforated lines such that the size of gap 13 can be punched out by the user depending on the type and size of debris they are trying to keep out of their drain. These embodiments are useful as they allow the manufacturer the ability to produce and the store owner the ability to shelve only one type of drain cover 1 as it can be applied to various drain types and for various draining purposes.

The shape of gap 13 is chosen from the group consisting of circle, triangle, square, rectangle, pentagon, hexagon, heptagon, octagon, nonagon, decagon, polygon, and combinations thereof. In some embodiments only one gap 13 is located on drain cover 1. In other embodiments there is more than one gap 13. In some embodiments the size of gap 13 is under 1 millimeter (mm). In other embodiments the size of gap 13 is between 1 and 2.5 mm, in other embodiments the size of gap 13 is between 2.5 and 5 mm, and in other embodiments the size of gap 13 is over 5 mm. In other embodiments the size of gap 13 is significantly larger than 5 mm, being between 2 and 10 centimeters.

The size and number of gaps 13 is important for different purposes. The larger the gap the better water will flow through drain cover 1, but the more likely hair or other debris will get through drain cover 1. Similarly, the more gaps 13 the better water will flow through drain cover 1, but the more likely hair or other debris will get through drain cover 1. If there are too few gaps 13 or the gaps 13 are too small, water flow will be limited and drain cover 1 will cause frustration in the consumer as it will clog and slow down the drain. However, if there are too many gaps 13 or the gaps 13 are too large, drain cover 1 will not be as effective of a cover. Thus, in many embodiments with only one gap 13, this gap will be larger than embodiments with multiple gaps 13. Embodiments where the size of gap 13 is less than 1 mm are useful for embodiments with multiple gaps 13, and when the debris or hair being generated is very fine, such as for collecting sand, silt, or other fine particles. Embodiments where the size of gap 13 is between 1 mm and 2.5 mm are also typically used combination with more than one gap 13, and are ideal for situations where particle size is still relatively small but greater water flow is desired, such as for a shower or sink when capturing facial, leg, or other short-haired shavings is desired. Embodiments where the size of gap 13 is between 2.5 and 5 mm are useful when water flow is a main concern and the size of the hair or debris is larger, such as for a shower drain where longer head hair is the main item clogging the drain. Embodiments where the size of gap 13 is larger than 5 mm are useful when maximum water flow is key and where longer hair or larger debris is the main filtering focus. As discussed above, embodiments where the size of gap 13 is significantly larger than 5 mm, namely between 2 and 10 centimeters are useful as they allow drain cover 1 to be placed around stopper 10 rather than on top of it.

In some embodiments with multiple gaps 13, all of the gaps are the same size, and in other embodiments the gaps are different sizes. Embodiments with all of the same size gaps 13 are useful for consistency and manufacturing purposes. Embodiments with different sized gaps 13 are useful as they allow for diversity in use, such as a drain cover 1 with a large central gap 13 which fits around stopper 10 as well as one or more smaller gaps 13 around the larger central gap which allow water flow around the stopper. Similarly, for embodiments where gap 13 has different sized perforations, the user can determine how many of what sized gaps they desire. For example, a user could choose to have 4 larger gaps to allow water flow with 10-15 smaller gaps to capture maximum debris. In some embodiments with multiple gaps 13, all of the gaps are the same shape, and in other embodiments the gaps are different shapes.

The location of gap 13 is also important. In some embodiments gap 13 is located outside of outer perimeter 2, in other embodiments gap 13 is located within outer perimeter 2, in other embodiments gap 13 is located within inner perimeter 3, in other embodiments gap 13 is located between inner perimeter 3 and outer perimeter 2, and in other embodiments gap 13 is located in a combination of the areas listed above. Embodiments where gap 13 is located outside of perimeter 2 are useful when flap 18 is folded up or down and filters the water running towards the center of drain cover 1. Embodiments where gap 13 is located within outer perimeter 2 are useful for covering and filtering the drain types shown in FIGS. 6A and 7A, when the water flows over drain cover 1. Embodiments where gap 13 is located within inner perimeter 3 are useful for covering and filtering the drain types shown in FIGS. 6B and 7B, where the region inside of inner perimeter 3 is placed on top of drain cover 9. Embodiments where gap 13 is located between inner perimeter 3 and outer perimeter 2 are useful for covering and filtering the drain types shown in FIGS. 6C and 7C, where petal 11 is wrapped around stopper 10. Embodiments with gap 13 in various areas are useful as it allows drain cover 1 to be used on any drain type discussed above.

In some embodiments, drain cover 1 is equipped with projection 14. Projection 14 projects off of drain cover 1, and when the water with hair or debris passes around projection 14 the hair and other loose objects become wrapped around and trapped on projection 14. In some embodiments projection 14 projects off of the top of drain cover 1 as a means of catching debris that flows over the top of and passes through drain cover 1. In other embodiments projection 14 projects off of the bottom of drain cover 1 and raises drain cover 1 off of the base of receptacle 6 and catches debris which flows through projection 14 on its way to the drain. In other embodiments projection 14 projects off of both the top and bottom of drain cover 1. The shape, size, and positioning of projection 14 is important in different embodiments.

The shape of projection 14 is selected from the group consisting of circle, triangle, square, rectangle, pentagon, hexagon, heptagon, octagon, nonagon, decagon, polygon, and combinations thereof. The shape of projection 14 determines how the water and objects will flow around it. Triangular shaped projections will split the water and cause hair to get entangled on the edge or point which faces the incoming water, thus, in many embodiments the triangle is pointed to face the oncoming water. Circular shapes cause the water to wrap around the surface of projection 14. Polygonal shapes cause the hair to wrap around the edges and points facing the water. In some embodiments with multiple projections 14 all of the projections 14 are the same shape and in other embodiments the projections 14 are different shapes. Embodiments where projections 14 are all the same shape are useful for ease of manufacturing and consistency of drain cover 1. Embodiments where projections 14 are different shapes are useful as different shapes divert the water and catch hair and debris in different ways, as discussed above. In some embodiments projection 14 is a solid piece and in others projection 14 contains holes or gaps, which further filter the water and trap particles, hair, or debris.

In some embodiments the size of projection 14 is under 2.5 millimeters. These embodiments are useful for embodiments where projection 14 projects from the bottom of drain cover 1 as it allows cover 1 to still be close to the bottom of receptacle 6 and filter water above and below it. In other embodiments the size of projection 14 is between 2.5 and 5 millimeters. These embodiments are useful for projecting off of the top of drain cover 1 as this size can effectively capture and entangle debris draining through or around projection 14. In other embodiments the size of projection 14 is over 5 millimeters. In some embodiment with more than one projection 14, the size of the different projections 14 are all the same, and in other embodiments the size of the different projections 14 are all different. Embodiments where projections 14 are all the same size are useful for ease of manufacturing and consistency of drain cover 1. Embodiments where projections 14 are different sizes are useful for diversity of straining or when projections 14 are found on both the top and bottom of drain cover 1.

In some embodiments, projection 14 is located outside of outer perimeter 2, in other embodiments projection 14 is located within outer perimeter 2, in other embodiments projection 14 is located within inner perimeter 3, in other embodiments projection 14 is located between inner perimeter 3 and outer perimeter 2, and in other embodiments projection 14 is located in a combination of the areas listed above. Embodiments where projection 14 is located outside of perimeter 2 are useful when flap 18 is folded up or down and filters the water running towards the center of drain cover 1. Embodiments where projection 14 is located within outer perimeter 2 are useful for covering and filtering the drain types shown in FIGS. 6A and 7A, when the water filters over drain cover 1. Embodiments where projection 14 is located within inner perimeter 3 are useful for covering and filtering the drain types shown in FIGS. 6B and 7B, where the region inside of inner perimeter 3 is placed on top of drain cover 9. Embodiments where projection 14 is located between inner perimeter 3 and outer perimeter 2 are useful for covering and filtering the drain types shown in FIGS. 6C and 7C, where petal 11 is wrapped around stopper 10. Embodiments with projection 14 in various areas are useful as it allows drain cover 1 to be used on any drain type discussed above.

The material of drain cover 1 is important depending on the embodiment, as a means of balancing the stability in water, flexibility of the material, and degradation in the environment. The material used to make drain cover 1 is selected from the group consisting of paper, plastic, metal, polymer, rubber, wood, and combinations thereof. Plastic, metal, rubber, and wood all are beneficially stable in water, paper and plastic are beneficially flexible, and paper is beneficially easily degraded in the environment. In some embodiments water resistant paper is used. In some embodiments the paper is coated with a polymer to make it water resistant and in other embodiments the paper pulp is mixed with a polymer which causes the final product to be water resistant.

In some embodiments, drain cover 1 consists of one layer and in other embodiments drain cover 1 consists of more than one layer. Embodiments where drain cover 1 is only one layer are useful for ease of construction, and embodiments where drain cover 1 is multiple layers is useful for stability and diversity of layer construction as this each layer's material can be optimized for a specific purpose. For instance, the lower layer can be a more robust material which does not degrade easily as it interacts with receptacle 6, while the top layer could be a material which can have a pattern more easily printed and affixed to it. Thus, in some embodiments with multiple layers, each later is made of generally the same materials and in other embodiments the layers are made of different materials.

Figure 3:
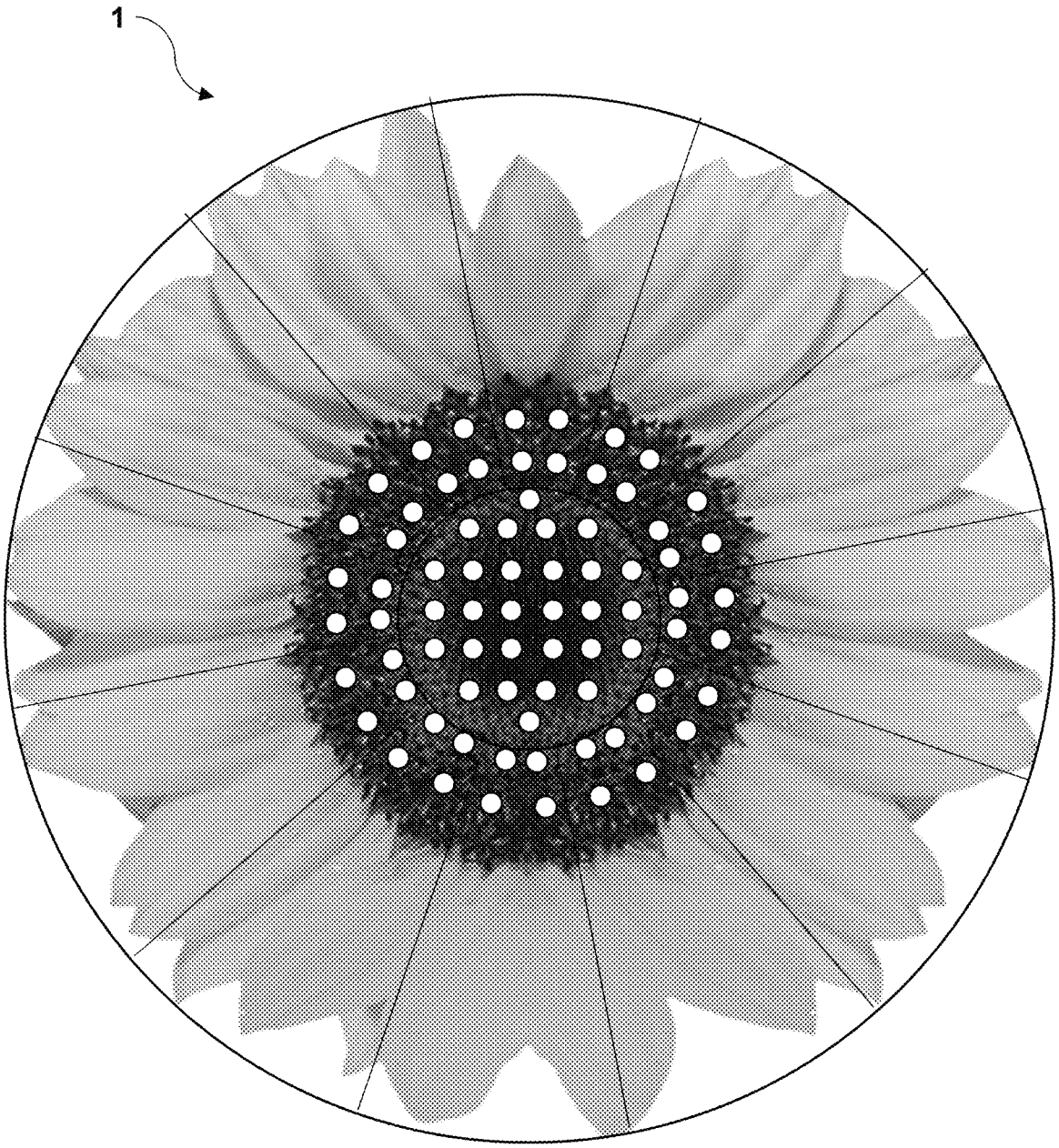
FIG. 3 shows a front view of the drain cover shown in FIG. 1.

In some embodiments a pattern, picture, or instructional material is printed on the top of drain cover 1, as seen in FIG. 3. These printings are designed to make drain cover 1 more aesthetically pleasing and to make them more enjoyable or understandable to use. In other embodiments the pattern, picture, or instructional material is printed on the bottom of cover 1. In some embodiments the printings are on both sides of cover 1 and in other embodiments the printings are on only one side of drain cover 1. In some embodiments where the printings are on both sides of drain cover 1, both of the printings are the same. These are useful in embodiments where the top and bottom of drain cover 1 are identical or interchangeable. In other embodiments where the printings are on both sides of drain cover 1, the printings are different. These embodiments help differentiate the top of drain cover 1 from the bottom of drain cover 1.

In some embodiments drain cover 1 is equipped with a fastener 19 which helps drain cover 1 stick to the drain, receptacle, stopper, or whatever other object it is covering. Fastener 19 is selected from the group consisting of suction cup, adhesive, tape, and combinations thereof. In some embodiments fastener 19 is located outside of outer perimeter 2, in other embodiments fastener 19 is located within outer perimeter 2, in other embodiments fastener 19 is located within inner perimeter 3, in other embodiments fastener 19 is located between inner perimeter 3 and outer perimeter 2, and in other embodiments fastener 19 is located in a combination of the areas listed above. Embodiments where fastener 19 is located outside of perimeter 2 are useful when flap 18 is folded up or down and filters the water running towards the center of drain cover 1. Embodiments where fastener 19 is located within outer perimeter 2 are useful for covering and filtering the drain types shown in FIGS. 6A and 7A, when the water filters over drain cover 1. Embodiments where fastener 19 is located within inner perimeter 3 are useful for covering and filtering the drain types shown in FIGS. 6B and 7B, where the region inside of inner perimeter 3 is placed on top of drain cover 9. Embodiments where fastener 19 is located between inner perimeter 3 and outer perimeter 2 are useful for covering and filtering the drain types shown in FIGS. 6C and 7C, where petal 11 is wrapped around stopper 10. Embodiments with fastener 19 in various areas are useful as it allows drain cover 1 to be used on any drain type discussed above.

In some embodiments drain cover 1 comprises a handle 20 which is used to remove drain cover 1 after use. In some embodiments handle 20 is fastened to the outermost perimeter 15, in other embodiments to outer perimeter 2, and in other embodiments within outer perimeter 2. In most embodiments handle 20 is designed such that pulling up on handle 20 will cause any debris or hair trapped within drain cover 1 to be balled up and contained within drain cover 1. In order to achieve this, in many embodiments handle 20 is fastened to at least four generally equally distributed spots along the outside edge of drain cover 1 such that pulling up of handle 20 causes the outside of drain cover 1 to be pulled up before the inside of drain cover 1 so that drain cover 1 encapsulates the items inside of it.

While the present invention has been particularly described, it is evident that many alternatives, modifications and variations will be apparent to those skilled in the art in light of the foregoing description. These descriptions and drawings are exemplary of specific embodiments only and are not intended to be limiting to the scope of the invention defined in the claims. It is therefore contemplated that the claims will embrace any such alternatives, modifications, and variations as falling within the true scope and spirit of the present invention.

What is claimed:

1. A drain cover comprising:

an outermost perimeter;

an outer perimeter separated from said outermost perimeter;

an inner perimeter which is separated from said outer perimeter;

at least one slit which extends between said outer perimeter and said inner perimeter and which creates a first section and a second section;

wherein when said drain cover is flat, said first section and said second section are generally in contact with one another in an area extending from said outer perimeter to said inner perimeter;

wherein at least part of the area inside of said outer perimeter further comprises at least one feature selected from the group consisting of projection, gap, and combinations thereof.

2. The drain cover according to claim 1, further comprising at least one notch which extends from said outermost perimeter to said outer perimeter.

3. The drain cover according to claim 1, wherein at least part of the area between said outer perimeter and said outermost perimeter further comprises at least one feature selected from the group consisting of projection, gap, and combinations thereof.

4. The drain cover according to claim 1, further comprising at least one fold line located within said outer perimeter.

5. The drain cover according to claim 4, wherein said at least one fold line is perforated.

6. The drain cover according to claim 1, further comprising at least one fastener selected from the group consisting of suction cup, adhesive, tape, and combinations thereof.

7. A drain cover comprising:

an outermost perimeter;

an outer perimeter separated from said outermost perimeter;

an inner perimeter which is separated from said outer perimeter;

a plurality of slits which extend from said outer perimeter to said inner perimeter;

a plurality of notches which extend from said outermost perimeter to said outer perimeter and which end at said plurality of slits;

a plurality of petals;

wherein an area of each petal is between said outermost perimeter on a top of said petal, said inner perimeter on a bottom of said petal, said slit on a first side of said petal, and said slit on a second side of said petal;

wherein said plurality of petals each further comprise a top surface and a bottom surface;

wherein each of said plurality of petals can be placed in the locations selected from the group consisting of on top of said top surface of another petal, below said bottom surface of another petal, or combinations thereof;

wherein at least a part of the area within said outer perimeter comprises at least one feature selected from the group consisting of projection, gap, and combinations thereof.

8. The drain cover according to claim 7, further comprising at least one fold line located within said outermost perimeter, and wherein at least one of said fold lines is said outer perimeter.

9. The drain cover according to claim 8, wherein said at least one fold line is perforated.

10. The drain cover according to claim 7, wherein said cover is made from at least two materials, and wherein at least one of said materials is water-resistant.

11. A drain cover comprising:

an outermost perimeter;

an outer perimeter separated from said outermost perimeter;

an inner perimeter which is separated from said outermost perimeter and said outer perimeter;

at least one slit located between said outer perimeter and said inner perimeter;

at least one notch which extends from said outermost perimeter to said outer perimeter;

at least one fold line located within said outermost perimeter;

wherein at least a part of the area within said outermost perimeter comprises at least one feature selected from the group consisting of projection, gap, and combinations thereof.

12. The drain cover according to claim 11, wherein said at least one slit is perforated.

13. The drain cover according to claim 11, wherein said cover is made from at least two materials, and wherein at least one of said materials is water-resistant.

14. The drain cover according to claim 11, wherein the termination of said at least one notch and the start of said at least one slit are located proximate to one another.

15. The drain cover according to claim 11, further comprising a fastener selected from the group consisting of suction cup, adhesive, tape, and combinations thereof.

16. The drain cover according to claim 11, further comprising:

a first notch width which is a width of said notch at said outermost perimeter;

a second notch width which is a width of said notch at said outer perimeter;

wherein said first notch width is larger than said second notch width.

17. The drain cover according to claim 16, wherein said second notch width is larger than the width of said at least one slit.

18. The drain cover according to claim 11, wherein areas divided by said at least one slit are generally in contact with one another when said drain cover is flat.

19. The drain cover according to claim 1, wherein said cover is made of paper.

20. The drain cover according to claim 7, wherein each of said plurality of petals further comprises:

a first width which is a width of said petal at said outermost perimeter;

a second width which is a width of said petal at said outer perimeter;

a third width which is a width of said petal at said inner perimeter;

wherein said second width is larger than said first width, and wherein said first width is larger than said third width.

* * * * *